United States Patent [19]

Smith

[11] 4,053,703

[45] Oct. 11, 1977

[54] CLAMPING CONNECTOR

[75] Inventor: Donald J. Smith, Woodland Hills, Calif.

[73] Assignee: Smith-Schreyer & Assoc., Inc., Woodland Hills, Calif.

[21] Appl. No.: 713,718

[22] Filed: Aug. 12, 1976

[51] Int. Cl.[2] ..... H01R 11/08; H01R 5/08

[52] U.S. Cl. ..... 174/78; 24/81 B; 174/87; 174/88 R; 339/14 L; 339/97 C

[58] Field of Search ..... 174/71 R, 78, 84 C, 174/87, 88 R; 339/14 R, 14 L, 95 R, 97 R, 97 C, 97 P, 276 R, 100; 24/81 R, 81 B, 81 CC, 81 DM, 81 PE, 115 A, 129 W, 243 A

[56] References Cited

U.S. PATENT DOCUMENTS

| | | | |
|---|---|---|---|
| 2,515,105 | 7/1950 | Weisberg | 339/97 C X |
| 3,760,331 | 9/1973 | Gurley | 339/97 P X |
| 3,864,009 | 2/1975 | Wickenberg | 339/95 R |

FOREIGN PATENT DOCUMENTS

| | | | |
|---|---|---|---|
| 1,124,208 | 6/1956 | France | 24/81 B |
| 431,557 | 7/1935 | United Kingdom | 339/100 |

*Primary Examiner*—Laramie E. Askin
*Attorney, Agent, or Firm*—Lyon & Lyon

[57] ABSTRACT

A formed member is disclosed which has a plurality of deformable jaws capable of being associated with the ends of small service wires to clamp the insulation and conductive shield. The clamping connector thus forms an electrical coupling with the shield and at the same time locates the ends of the service wires relative to one another. An attachment portion enables the shield to be grounded and the clamped service wires to be positioned relative to a splice enclosure or other fixture. The deformable jaws interlock when deformed to hold a service wire such that purchase is insured on the insulation and conductive shield.

4 Claims, 3 Drawing Figures

CLAMPING CONNECTOR

BACKGROUND OF THE INVENTION

The present invention is directed to a clamping connector employed with a plurality of small service wires. More specifically, the present invention is directed to a clamping connector having deformable jaws for association with a plurality of small service wires.

A satisfactory bonding connector for small service wires has not been previously available. Generally, small service wires include a central conductive core wrapped in insulation. A conductive shield is placed around this inner insulation and external insulation is provided in turn around the shield. It is not uncommon for a bonding connector of conventional design not to make proper contact with the shield. Furthermore, conventional bonding connectors generally employ a plurality of parts requiring assembly over the end of the small service wire. The assembly is then subjected to deformation by the use of pliers to squeeze the connector and the service wire. In order for the connector to properly contact and remain with the shield, reliance on the structural nature of the service wire is required.

SUMMARY OF THE INVENTION

The present invention is directed to a bonding connector having deformable clamps thereon which are easily associated with the shield and outer insulation of a small service wire. A conventional pair of long-nose pliers is employed to install the single piece connector. The direct deforming action insures the electrical association of the deformable clamp with the shield. The secure clamping of the connector to the outer insulation of the small service wire also allows positioning of the end of the wire with mechanical security. The one piece construction also reduces a possibility of installer error.

Accordingly, it is an object of the present invention to provide an improved bonding connector.

It is a further object of the present invention to provide a bonding connector which directly clamps into the outer insulation and the shield of a small service wire.

Other and further objects and advantages will appear hereinafter.

DETAILED DESCRIPTION OF THE PREFERRED EMBODIMENT

Figure 1:
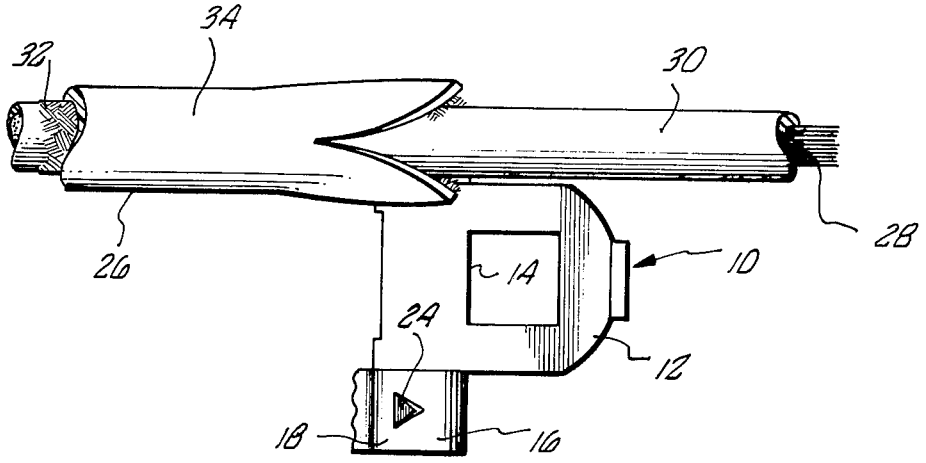
FIG. 1 is a plan view of the present invention with one small service wire in place.

Turning in detail to the drawings, a clamping connector generally designated 10 is illustrated which includes a central attachment portion defined by a flat, conductive plate 12 having a hole 14 extending therethrough for facile attachment to any convenient supporting frame. At either side of the plate 12 is a deformable clamp 16. In FIG. 1, only one clamp is clearly visible because of the placement of a small service wire in association with the second clamp.

Figure 2:
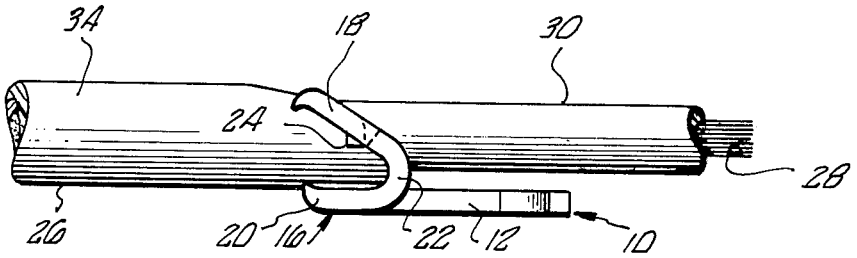
FIG. 2 is an elevation of the configuration of FIG. 1.
Figure 3:
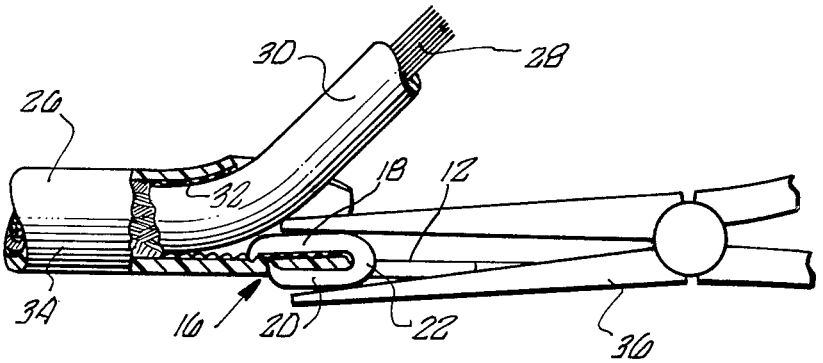
FIG. 3 is an elevation with a portion of the insulation and shield of a small service wire in cross-section to illustrate employment of the present invention.

Each clamp 16 includes a first jaw portion 18, a second jaw portion 20 and an intermediate portion 22 extending to one end of each of said first and second jaw portions 18 and 20, respectively. The second jaw portion 20 is constructed as an extension of the plate 12 while the intermediate portion 22 and the first jaw portion 18 are formed from the plate 12 by shearing these portions therefrom and bringing them upwardly to form such an opposed, spaced relationship as can be seen in FIG. 2.

The first jaw portion 18 is formed such that it will extend over the end of the second jaw portion 20 when clamped together. A serrated, inwardly extending edge on each jaw portion 18 and 20 improves the bite into both the shield and the outer insulation of the small service wire. A tooth 24 is also formed in the first jaw portion 18 to insure electrical contact with the shield of the small service wire and further to add to the holding ability of the clamp.

A small service wire, generally designated 26, used for telephone lead wires and the like, is illustrated here as including a central conductor core 28, an inner insulation 30, a thin metallic shield 32 and external insulation 34. When such a small service wire is to be terminated, the inner and outer insulation 30 and 34 and the metallic shield 32 are cut away from the conductor core. Normally, the inner insulation 30 extends beyond the end of the external insulation 34 and the metallic shield 32 as can be seen in the figures. The external insulation and metallic shield are then cut longitudinally as best seen in FIG. 1 to partially free the external insulation 34 from around the inner insulation 30.

A clamp 16 is then inserted on to the end of the external insulation 34 such that both the external insulation 34 and the metallic shield 32 extend between the first and second jaw portions 18 and 20. Long-nose pliers 36 may then be used to bring the two jaw portions 18 and 20 into close relationship such that the outer insulation 34 and the metallic shield 32 are deformed and tightly gripped. Simultaneously, electrical contact is made between the metallic shield 32 and at least the tooth 24. The shield 32 may then be grounded through the clamping connector.

Two such small service wires 26 may be positioned on the clamping connector 10. If only one such small service wire 26 is contemplated, one of the two clamps 16 may be easily clipped from the connector. The clamps 16 are also shown to be disposed in parallel relationship such that the positioned small service wires 26 will both extend in a common direction. It is anticipated that this parallel relationship will provide the most convenient arrangement. However, other locations of the clamps may be used without departing from the present invention.

Thus, a highly useful, inexpensive and reliable means is disclosed for clamping, positioning and grounding a plurality of small service wires. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A clamping connector for receiving the ends of small service wires of the type having a conductor core, external insulation and a conductive shield, comprising a plurality of deformable clamps, each said clamp having a first jaw portion defining a first jaw of said clamp, a second jaw portion defining a second jaw of said clamp and an intermediate portion extending to said first and second jaw portions and holding said first and second jaw portions spaced one from the other for receipt of the external insulation and the conductive shield of the small service wire, each said jaw portion including means at an outer end thereof for increasing purchase on the small service wire when associated therewith, each said clamp being constructed and arranged to allow selective distortion of said clamp to bring said jaw portions permanently close together to hold the small service wire from association therewith and to electrically connect the conductive shield, each said jaw portion including an inwardly extending outer end thereof, said inwardly extending end of said first jaw portion extending outwardly of said second jaw portion to form an interlocking of said inwardly extending ends when said jaw portions are brought permanently close together; and an attachment plate rigidly fixed to and electrically associated with said deformable clamps.

2. The clamping connector of claim 1 wherein two said deformable clamps are fixed to said attachment plate.

3. The clamping connector of claim 1 wherein said first jaw portion includes a tooth extending inwardly from the center thereof to engage and electrically connect the conductive shield.

4. The clamping connector of claim 1 wherein said deformable clamps are disposed in parallel relationship to receive parallel incoming small service wires.

* * * * *